US008525612B2

(12) United States Patent
Furutani

(10) Patent No.: US 8,525,612 B2
(45) Date of Patent: Sep. 3, 2013

(54) CIRCUIT MODULE

(75) Inventor: Koji Furutani, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/552,667

(22) Filed: Jul. 19, 2012

(65) Prior Publication Data

US 2013/0181786 A1 Jul. 18, 2013

(30) Foreign Application Priority Data

Jan. 21, 2010 (JP) ..... 2010-010614

(51) Int. Cl.
*H01P 1/36* (2006.01)

(52) U.S. Cl.
USPC ..... 333/24.2; 333/1.1

(58) Field of Classification Search
USPC ..... 333/1.1, 24.2
See application file for complete search history.

(56) References Cited

U.S. PATENT DOCUMENTS

| | | | | |
|---|---|---|---|---|
| 5,185,587 | A * | 2/1993 | Kurian et al. | 333/1.1 |
| 2001/0028280 | A1 | 10/2001 | Maruhashi et al. | |
| 2006/0022766 | A1 | 2/2006 | Ishigaki et al. | |
| 2009/0315656 | A1 | 12/2009 | Wada et al. | |

FOREIGN PATENT DOCUMENTS

| | | | |
|---|---|---|---|
| JP | 05-083001 | A | 4/1993 |
| JP | 06-268414 | A | 9/1994 |
| JP | 09-289403 | A | 11/1997 |
| JP | 11-154806 | A | 6/1999 |
| JP | 2005-183410 | A | 7/2005 |
| JP | 2006-049969 | A | 2/2006 |
| JP | 2006-279604 | A | 10/2006 |
| JP | 2006-311455 | A | 11/2006 |
| JP | 2009-296051 | A | 12/2009 |
| JP | 2010-010805 | A | 1/2010 |
| JP | 2010-178014 | A | 8/2010 |

OTHER PUBLICATIONS

Official Communication issued in International Patent Application No. PCT/JP2010/072896, mailed on Mar. 29, 2011.

* cited by examiner

*Primary Examiner* — Stephen Jones
(74) *Attorney, Agent, or Firm* — Keating & Bennett, LLP

(57) ABSTRACT

A circuit module having reduced magnetic coupling between core isolators. A substrate body includes principal surfaces. A core isolator includes a ferrite, a permanent magnet that applies a DC magnetic field to the ferrite, a first center electrode provided for the ferrite and including one end connected to an input port and another end connected to an output port, and a second center electrode provided for the ferrite so as to intersect the first center electrode insulated from the second center electrode and that includes one end connected to the output port and another end connected to a ground port. The core isolator also includes no yokes preventing leakage of the DC magnetic field to the outside. The core isolators are mounted on the respective principal surfaces such that directions of the DC magnetic fields are parallel or substantially parallel to the principal surface.

9 Claims, 6 Drawing Sheets

CIRCUIT MODULE

BACKGROUND OF THE INVENTION

1. Field of the Invention

The present invention relates to circuit modules, and more particularly to a circuit module including multiple core isolators.

2. Description of the Related Art

A known isolator is, for example, a non-reciprocal circuit element described in Japanese Unexamined Patent Application Publication No. 2006-311455. This non-reciprocal circuit element includes a ferrite having a pair of principal surfaces that oppose each other, multiple center electrodes, permanent magnets having principal surfaces that oppose the principal surfaces of the ferrite, and a circuit board. The multiple center electrodes are formed of a conductor film on the principal surfaces of the permanent magnets so as to intersect each other and be insulated from each other. The center electrodes are also electrically connected to each other via intermediate electrodes formed on edge surfaces that are orthogonal to the principal surfaces of the ferrite. Further, both of the ferrite and the permanent magnets are arranged on the circuit board in such an orientation that the principal surfaces thereof are orthogonal to a surface of the circuit board. The non-reciprocal circuit element as described above is used in, for example, a communication apparatus.

Recently, as a demand for reductions in size of a communication apparatus arises, a demand for reductions in size of a non-reciprocal circuit element has been increased. Accordingly, removal of a yoke for suppressing leakage of magnetic flux to the outside has been proposed for the non-reciprocal circuit element described in Japanese Unexamined Patent Application Publication No. 2006-311455.

However, when the yoke is removed from a non-reciprocal circuit element, magnetic flux leaks from around the non-reciprocal circuit element. Since a communication apparatus has multiple non-reciprocal circuit elements mounted therein, when the leakage of magnetic flux occurs, the non-reciprocal circuit elements are magnetically coupled with each other. As a result, the characteristics of the non-reciprocal circuit elements are changed.

SUMMARY OF THE INVENTION

Preferred embodiments of the present invention provide a circuit module in which multiple isolators (core isolators) having no yokes are mounted to achieve significant reduction and prevention of magnetic coupling between the core isolators.

A circuit module according to one aspect of a preferred embodiment of the present invention includes a multilayer body including a plurality of insulating layers stacked on top of one another, and first and second core isolators each including a ferrite, a permanent magnet that applies a direct-current magnetic field to the ferrite, a first center electrode that is provided for the ferrite and that has one end thereof connected to an input port and the other end thereof connected to an output port, and a second center electrode that is provided for the ferrite so as to intersect the first center electrode insulated from the second center electrode and that has one end thereof connected to the output port and the other end thereof connected to a ground port. The first and second core isolators have no yokes preventing leakage of the direct-current magnetic field to the outside. Each of the first and second core isolators is mounted on a different one of the insulating layers such that the direction of the direct-current magnetic field is parallel or substantially parallel to a principal surface of the insulating layers.

According to various preferred embodiments of the present invention, a circuit module in which multiple core isolators having no yokes are mounted enables magnetic coupling between the core isolators to be significantly reduced and prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A circuit module according to preferred embodiments of the present invention will be described below with reference to the drawings.

Figure 1A:
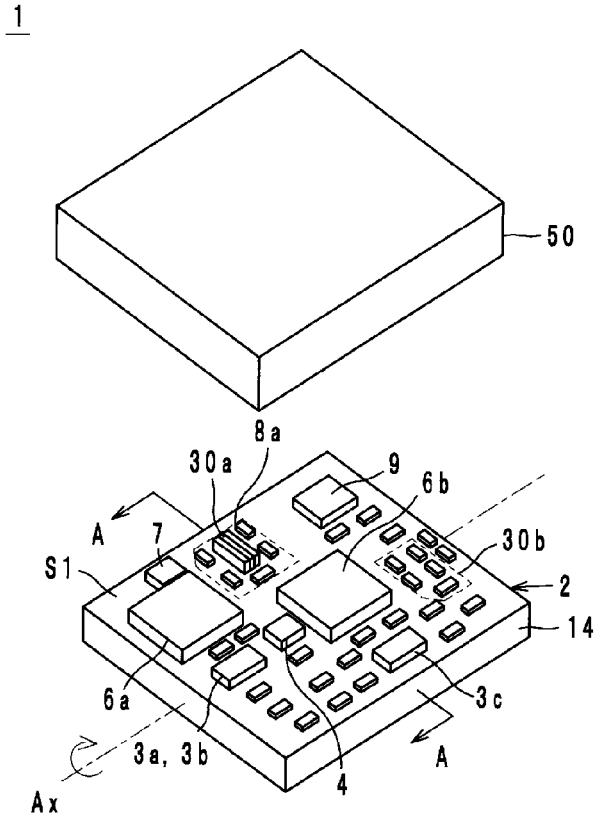
FIGS. 1A and 1B include exploded perspective views of a circuit module according to a preferred embodiment of the present invention.
Figure 1B:
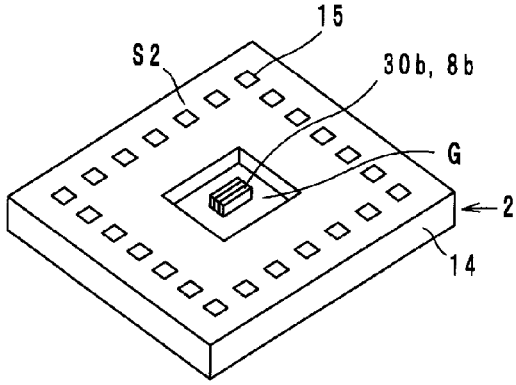
Figure 2:
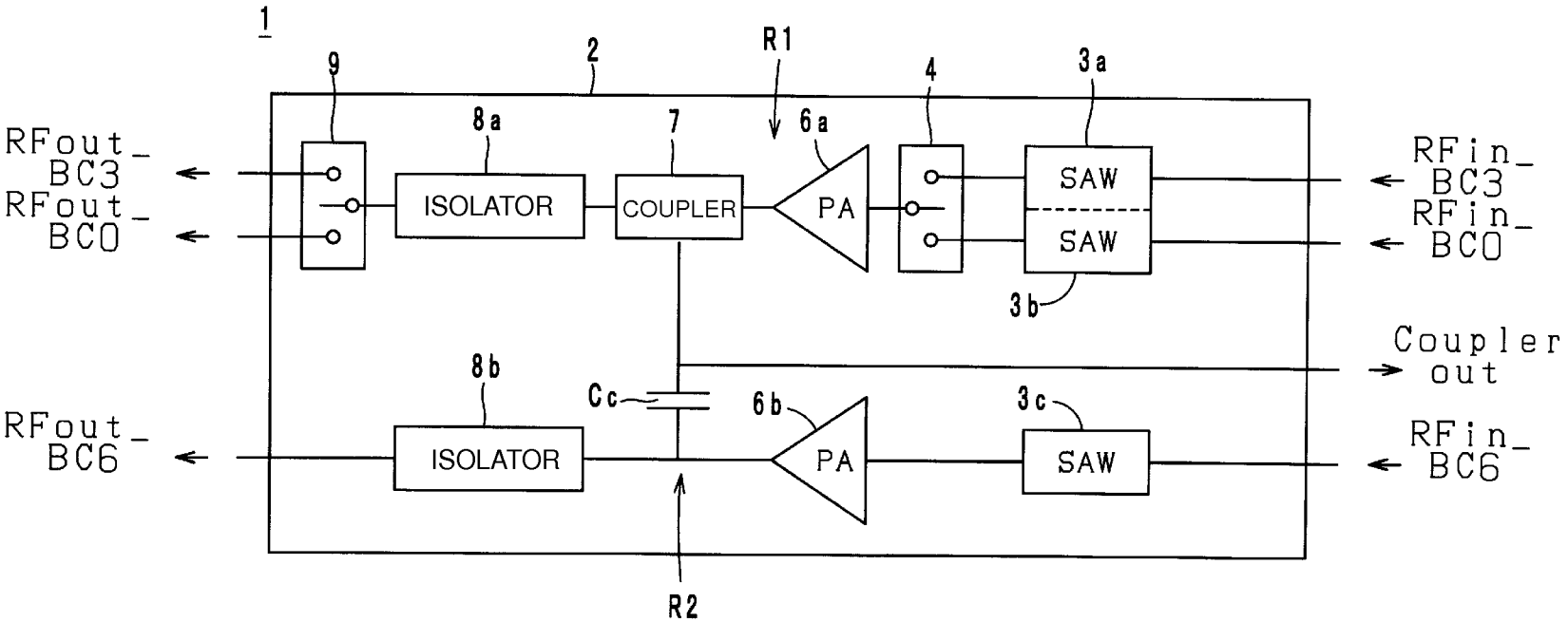
FIG. 2 is a block diagram of the circuit module in FIG. 1.
Figure 3:
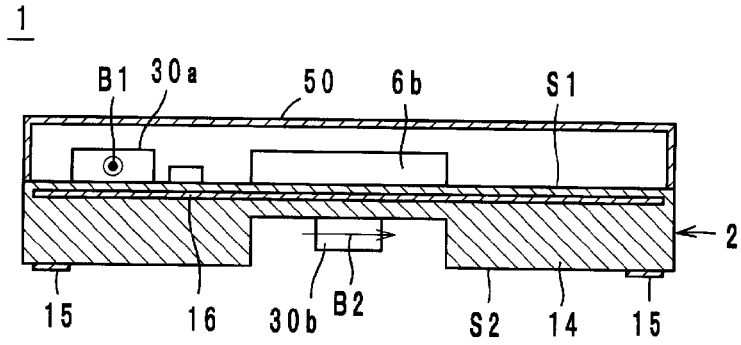
FIG. 3 is a sectional structure view taken along the line A-A of the circuit module in FIG. 1.

Now, a configuration of the circuit module will be described with reference to the drawings. FIGS. 1A and 1B includes exploded perspective views of a circuit module 1 according to a preferred embodiment of the present invention. FIG. 1A is an exploded perspective view of the circuit module 1 viewed from the upper side. FIG. 1B is an exploded perspective view of the circuit module 1 rotated by 180° around the axis Ax. FIG. 2 is a block diagram of the circuit module 1 in FIGS. 1A and 1B. FIG. 3 is a sectional structure view taken along the line A-A of the circuit module 1 in FIGS. 1A and 1B. In FIGS. 1A and 1B, only main electronic components are illustrated, and small electronic components, such as a chip capacitor and a chip inductor, are omitted.

The circuit module 1 constitutes a portion of a transmission circuit of a wireless communication device such as a cellular phone, and amplifies and outputs multiple types of high-frequency signals. As illustrated in FIGS. 1A, 1B and 2, the circuit module 1 includes a circuit board 2, transmission paths R1 and R2 (not illustrated in FIGS. 1A and 1B), and a metal case 50.

As illustrated in FIGS. 1A, 1B and 3, the circuit board 2 preferably is a plate-shaped multilayer printed board on which and in which electric circuits are provided. As illustrated in FIGS. 1A, 1B and 3, the circuit board 2 includes a substrate body 14, outer electrodes 15, and a ground conductor layer 16. The substrate body 14 includes principal surfaces S1 and S2. As illustrated in FIG. 1B, a recess G is provided in a center portion of the principal surface S2.

As illustrated in FIGS. 1A and 1B, the outer electrodes 15 are aligned along each of the sides of the principal surface S2 of the substrate body 14, and connect the electric circuits in the circuit board 2 to electric circuits outside the circuit board 2. As illustrated FIG. 3, the ground conductor layer 16 is a conductor layer provided in the substrate body 14, and is electrically connected to the outer electrodes 15 through via hole conductors (not illustrated) such that a ground potential is applied.

As illustrated in FIG. 2, in the transmission path R1, input signals RFin_BC0 (800 MHz band) and RFin_BC3 (900 MHz band) are amplified and output as output signals RFout_BC0 (800 MHz band) and RFout_BC3 (900 MHz band). As illustrated in FIG. 2, the transmission path R1 preferably includes surface acoustic wave filters (SAW filters) 3*a* and 3*b*, a switch 4, a power amplifier (amplifier) 6*a*, a coupler 7, an isolator 8*a*, and a switch 9. As illustrated in FIGS. 1A and 1B, the SAW filters 3*a* and 3*b*, the switch 4, the power amplifier 6*a*, the coupler 7, the isolator 8*a*, and the switch 9 are electronic components mounted on the principal surface S1 of the substrate body 14.

As illustrated in FIGS. 1A and 1B, the SAW filters 3*a* and 3*b* are included in one electronic component, and are band-pass filters each of which allows only a signal of a predetermined frequency to pass therethrough. As illustrated in FIG. 2, the SAW filters 3*a* and 3*b* are electrically connected to an input terminal (not illustrated) of the power amplifier 6*a* through the switch 4. As illustrated in FIG. 2, the SAW filter 3*a* receives the input signal RFin_BC3. As illustrated in FIG. 2, the SAW filter 3*b* receives the input signal RFin_BC0.

As illustrated in FIG. 2, the switch 4 is connected to the SAW filters 3*a* and 3*b* and the power amplifier 6*a*, and outputs either the input signal RFin_BC3 that is output from the SAW filter 3*a* or the input signal RFin_BC0 that is output from the SAW filter 3*b*, to the power amplifier 6*a*.

The power amplifier 6*a* amplifies the input signal RFin_BC0 or RFin_BC3 that is output from the switch 4. As illustrated in FIG. 2, the power amplifier 6*a* is connected to an input terminal (not illustrated) of the coupler 7 located downstream. As illustrated in FIG. 2, the coupler 7 is connected to an input terminal (not illustrated) of the isolator 8*a*. The coupler 7 divides the input signal RFin_BC0 or RFin_BC3 amplified by the power amplifier 6*a* to output the divided portion as an output signal Coupler out to the outside of the circuit module 1, and outputs the input signal RFin_BC0 or RFin_BC3 to the isolator 8*a* located downstream.

As illustrated in FIG. 2, the isolator 8*a* preferably is a non-reciprocal circuit element that outputs the input signal RFin_BC0 or RFin_BC3 to the switch 9 located downstream and that does not output a signal reflected from the switch 9 side, to the coupler 7 side. The isolator 8*a* will be described in detail below. As illustrated in FIG. 2, the switch 9 outputs either of the input signals RFin_BC0 and RFin_BC3 that is output from the isolator 8*a*, as the output signal RFout_BC0 or RFout_BC3 to the outside of the circuit module 1.

As illustrated in FIG. 2, in the transmission path R2, an input signal RFin_BC6 (1900 MHz band) is amplified and output as an output signal RFout_BC6 (1900 MHz band). As illustrated in FIG. 2, the transmission path R2 preferably includes a SAW filter 3*c*, a power amplifier 6*b*, and an isolator 8*b*. As illustrated in FIG. 1, the SAW filter 3*c*, the power amplifier 6*b*, and the isolator 8*b* are electronic components mounted on the circuit board 2.

As illustrated in FIG. 2, a capacitor Cc is provided between the wiring line through which the output signal Coupler out is output and the transmission path R2. More specifically, the capacitor Cc is connected to a point between the isolator 8*b* and the power amplifier 6*b* at one end thereof, and is connected to the wiring line through which the output signal Coupler out is output at the other end thereof. The capacitor Cc outputs a portion of the input signal RFin_BC6 amplified by the power amplifier 6*b*, as the output signal Coupler out to the outside of the circuit module 1.

The SAW filter 3*c* is a band-pass filter that allows only a signal of a predetermined frequency to pass therethrough. As illustrated in FIG. 2, the SAW filter 3*c* receives the input signal RFin_BC6.

As illustrated in FIG. 2, the power amplifier 6*b* amplifies the input signal RFin_BC6 that is output from the SAW filter 3*c*. As illustrated in FIG. 2, the isolator 8*b* is a non-reciprocal circuit element that outputs the input signal RFin_BC6 to the outside of the circuit module 1 and that does not output a signal reflected from the outside of the circuit module 1, to the power amplifier 6*b* side. The isolator 8*b* will be described in detail below.

The metal case 50 is mounted on the principal surface S1 of the substrate body 14, and covers the SAW filters 3*a* to 3*c*, the switch 4, the power amplifiers 6*a* and 6*b*, the coupler 7, the isolator 8*a*, and the switch 9. Further, a ground potential is applied to the metal case 50 through the electric circuits in the substrate body 14.

Figure 4:
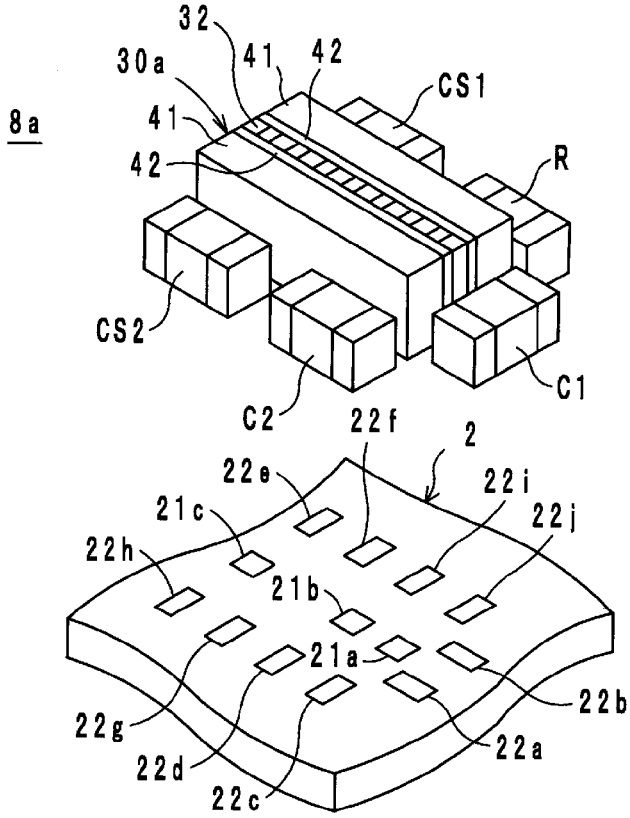
FIG. 4 is an external perspective view of an isolator.
Figure 5:
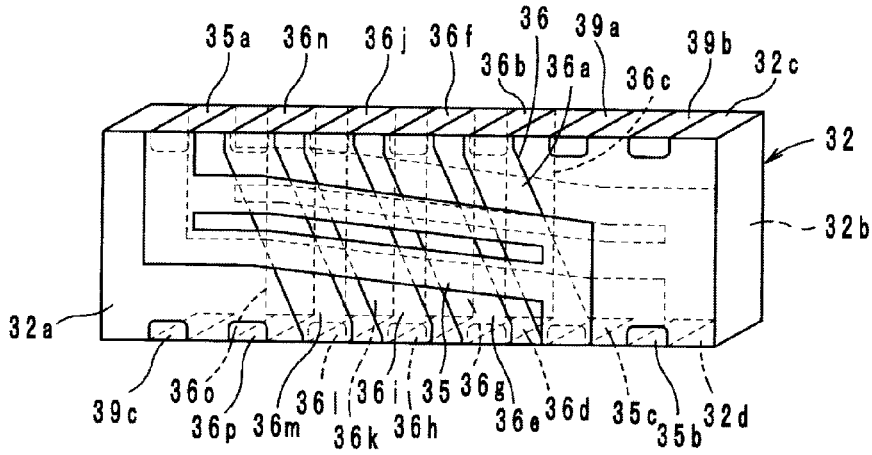
FIG. 5 is an external perspective view of a ferrite including center electrodes.
Figure 6:
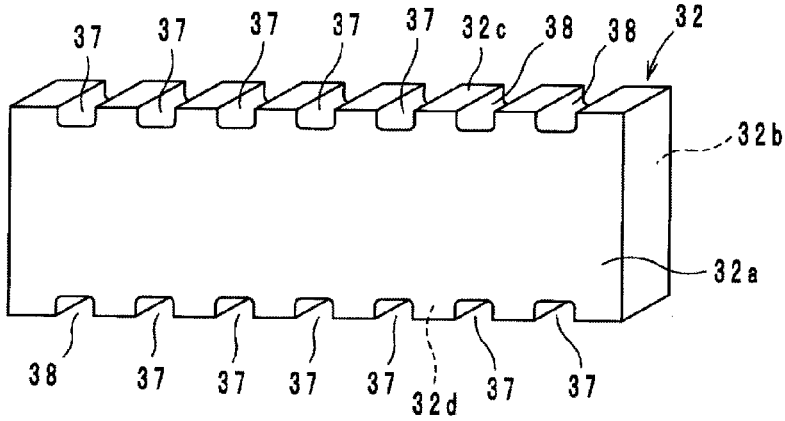
FIG. 6 is an external perspective view of a ferrite.
Figure 7:
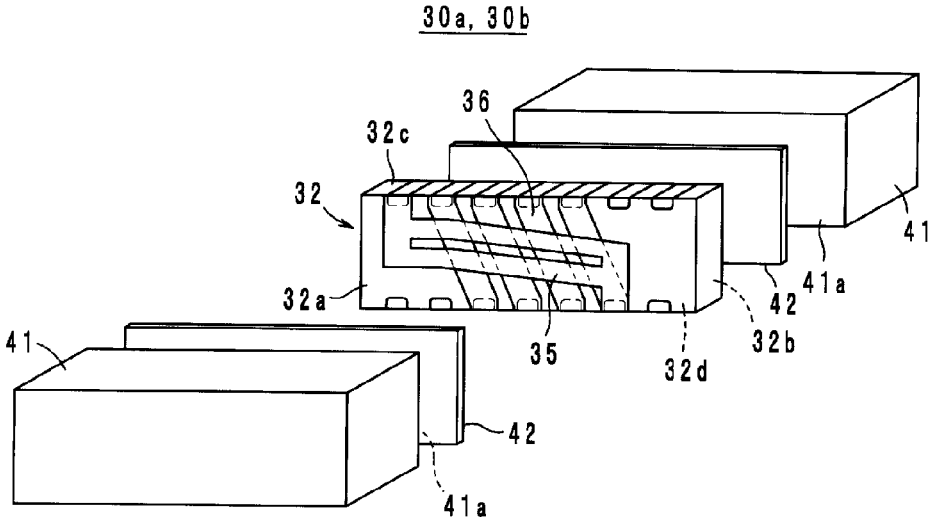
FIG. 7 is an exploded perspective view of a core isolator.

The isolators 8*a* and 8*b* will be described below with reference to the drawings. FIG. 4 is an external perspective view of the isolator 8*a*. FIG. 5 is an external perspective view of a ferrite 32 including center electrodes 35 and 36. FIG. 6 is an external perspective view of the ferrite 32. FIG. 7 is an exploded perspective view of a core isolator 30*a* or 30*b*.

The isolator 8*a* is a lumped element isolator, and preferably includes the circuit board 2, the core isolator 30*a*, capacitors C1, C2, CS1, and CS2, and a resistor R as illustrated in FIG. 4. Similarly to the isolator 8*a*, the isolator 8*b* is also a lumped element isolator, and preferably includes the circuit board 2, the core isolator 30*a*, the capacitors C1, C2, CS1, and CS2, and the resistor R. Note that, as illustrated in FIG. 1, in the isolator 8*b*, the core isolator 30*b* is located separately from the capacitors C1, C2, CS1, and CS2, and the resistor R. However, the isolators 8*a* and 8*b* basically have the same configuration, and thus the isolator 8*a* will be described as an example below.

As illustrated in FIG. 4, the core isolator 30*a* includes the ferrite 32 and a pair of permanent magnets 41. Note that the core isolator 30*a* in the present preferred embodiment preferably is a component constituted only by the ferrite 32 and the permanent magnets 41. As illustrated in FIG. 5, the ferrite is provided with the center electrodes 35 and 36 that are electrically insulated from each other on front and back principal surfaces 32*a* and 32*b* thereof. The ferrite 32 preferably has a rectangular parallelepiped shape including the principal surfaces 32*a* and 32*b* that oppose each other and that are parallel or substantially parallel to each other.

The permanent magnets 41 are attached to the principal surfaces 32*a* and 32*b*, for example, via epoxy adhesives 42 so that a direct-current field is applied to the ferrite 32 in a direction substantially perpendicular to the principal surfaces 32*a* and 32*b* (see FIG. 7). A principal surface 41*a* of each of the permanent magnets 41 preferably has the same dimensions or substantially the same dimensions as those of the principal surfaces 32*a* and 32*b* of the ferrite 32. The ferrite 32 and each of the permanent magnets 41 are arranged so as to oppose each other in a state where the outer shape of the principal surfaces 32*a* and 32*b* matches the outer shape of the principal surface 41*a*.

The center electrode 35 preferably is a conductor film. That is, as illustrated in FIG. 5, on the principal surface 32*a* of the ferrite 32, the center electrode 35 extends upward from the lower right side, branches into two portions, and then extends obliquely to the upper left at a relatively small angle relative to the long sides of the principal surface 32*a* in this branching state. Then, the center electrode 35 extends upward to the upper left side and then around onto the principal surface 32*b* via an intermediate electrode 35*a* on an upper surface 32*c*. Further, the center electrode 35 is arranged such that the center electrode 35 on the principal surface 32*b* branches into two portions so as to be superposed with the portion thereof on the principal surface 32*a* in perspective view. The center electrode 35 is connected to a connection electrode 35*b* located on a lower surface 32*d* at one end thereof, whereas the center electrode 35 is connected to a connection electrode 35*c* located on the lower surface 32*d* at the other end thereof. In this manner, the center electrode 35 is wound around the ferrite 32 in one turn. The center electrode 35 intersects the center electrode 36, which will be described below, in a state in which the center electrodes 35 and 36 are insulated from each other by an insulating film provided therebetween. The angle at which the center electrode 35 intersects the center electrode 36 is set as necessary so that the input impedance and the insertion loss are adjusted.

The center electrode 36 preferably is a conductor film. The center electrode 36 is arranged in the following manner. A 0.5-turn portion 36*a* is located on the principal surface 32*a* so as to extend obliquely from the lower right to the upper left at a relatively large angle relative to the long sides of the principal surface 32*a* and so as to intersect the center electrode 35. The 0.5-turn portion 36*a* extends around onto the principal surface 32*b* via an intermediate electrode 36*b* on the upper surface 32*c*. A one-turn portion 36*c* is arranged on the principal surface 32*b* so as to substantially perpendicularly intersect the center electrode 35. The one-turn portion 36*c* extends around onto the principal surface 32*a* via an intermediate electrode 36*d* on the lower surface 32*d* at the lower end thereof. A 1.5-turn portion 36*e* is arranged on the principal surface 32*a* so as to extend parallel to the 0.5-turn portion 36*a* and so as to intersect the center electrode 35, and extends around onto the principal surface 32*b* via an intermediate electrode 36*f* on the upper surface 32*c*. Similarly, a 2-turn portion 36*g*, an intermediate electrode 36*h*, a 2.5-turn portion 36*i*, an intermediate electrode 36*j*, a 3-turn portion 36*k*, an intermediate electrode 36*l*, a 3.5-turn portion 36*m*, an intermediate electrode 36*n*, and a 4-turn portion 36*o* are provided on the surfaces of the ferrite 32. One end and the other end of the center electrode 36 are connected to the connection electrode 35*c* and a connection electrode 36*p*, respectively, which are located on the lower surface 32*d* of the ferrite 32. The connection electrode 35*c* is shared as a connection electrode at an end of each of the center electrode 35 and the center electrode 36.

The connection electrodes 35*b*, 35*c*, and 36*p* and the intermediate electrodes 35*a*, 36*b*, 36*d*, 36*f*, 36*h*, 36*j*, 36*l*, and 36*n* are provided preferably by applying an electrode conductor, such as silver, a silver alloy, copper, or a copper alloy, to recesses 37 (see FIG. 6) provided in the upper surface 32*c* and the lower surface 32*d* of the ferrite 32 or by filling the recesses 37 with the electrode conductor. In addition, recesses 38 are provided in the upper surface 32*c* and the lower surface 32*d* so as to be parallel or substantially parallel to the various electrodes, and dummy electrodes 39*a*, 39*b*, and 39*c* are provided. Such electrodes are provided preferably by forming through holes in advance in a mother ferrite board, filling the through holes with an electrode conductor, and then cutting the mother ferrite board at positions where the through holes are to be divided. These various electrodes may be conductor films in the recesses 37 and 38.

For example, a YIG ferrite is preferably used as the ferrite 32. The center electrodes 35 and 36 and the various electrodes can be provided as a thick or thin film of silver or a silver alloy by a method, such as printing, transferring, or photolithography, for example. As the insulating film between the center electrodes 35 and 36, a dielectric thick film of glass, alumina, or the like, or a resin film of polyimide or the like can be used, for example. These elements can be also formed by a method, such as printing, transferring, or photolithography.

Note that the ferrite 32 together with the insulating film and the various electrodes can be collectively fired using a magnetic material. In this case, Pd, Ag, or Pd/Ag, which are resistant to firing at high temperature, is preferably used for the various electrodes.

Strontium, barium, or lanthanum-cobalt ferrite magnets are preferably used for the permanent magnets 41, for example. One-component thermosetting epoxy adhesives are preferably used as the adhesives 42 that attach the permanent magnets 41 to the ferrite 32.

The circuit board 2 is preferably made of the same type of a material as that of a typical printed wiring circuit board, but may be a multilayer ceramic board obtained by stacking multiple ceramic insulating layers on top of one another. For example, terminal electrodes 21*a*, 21*b*, 21*c*, and 22*a* to 22*j* for mounting the core isolator 30*a*, the capacitors C1, C2, CS1, and CS2, and the resistor R, input/output electrodes, a ground electrode (not illustrated) are provided on a surface of the circuit board 2.

The core isolator 30*a* is mounted on the circuit board 2. Specifically, the connection electrodes 35*b*, 35*c*, and 36*p* on the lower surface 32*d* of the ferrite 32 are unified with the terminal electrodes 21*a*, 21*b*, and 21*c* on the circuit board 2 by reflow soldering. In addition, the permanent magnets 41 are unified with the circuit board 2 at the lower surfaces thereof preferably via adhesives. Further, the capacitors C1, C2, CS1, and CS2 and the resistor R are reflow-soldered to the terminal electrodes 22*a* to 22*j* on the circuit board 2. The core isolator 30*a*, the capacitors C1, C2, CS1, and CS2, and the resistor R are connected to one another through wiring lines in the circuit board 2, constituting an isolator 8*a*.

Figure 8:
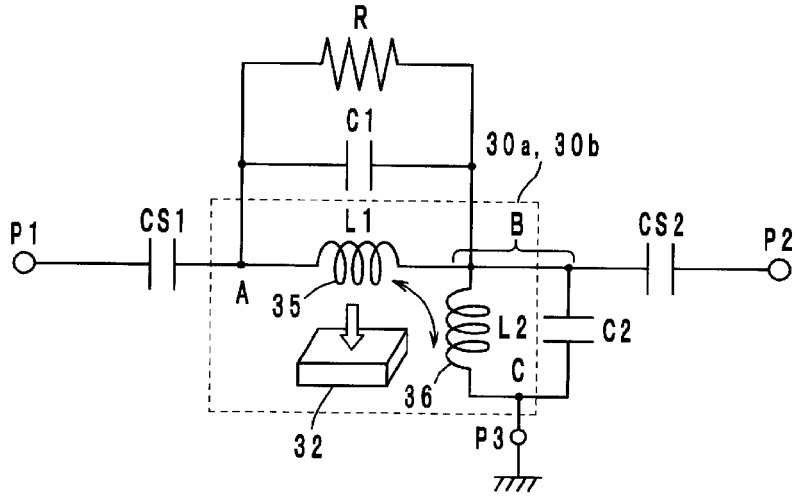
FIG. 8 is an equivalent circuit diagram of an isolator.

Now, the circuit configuration of the isolators 8*a* and 8*b* will be described with reference to the drawing. FIG. 8 is an equivalent circuit diagram of the isolator 8*a* or 8*b*.

An input port P1 is connected to the capacitor C1 and the resistor R through the capacitor CS1. The capacitor CS1 is connected to one end of the center electrode 35. The other end of the center electrode 35 and one end of the center electrode 36 are connected to the resistor R and the capacitors C1 and C2, and connected to an output port P2 through the capacitor CS2. The other end of the center electrode 36 and the capacitor C2 are connected to a ground port P3.

In the isolators 8*a* and 8*b* each having the equivalent circuit described above, the center electrode 35 is connected to the input port P1 at the one end thereof and to the output port P2 at the other end thereof, and the center electrode 36 is connected to the output port P2 at the one end thereof and to the ground port P3 at the other end thereof, achieving a two-port lumped element isolator having low insertion loss.

In addition, the core isolators 30*a* and 30*b*, in which the ferrite 32 is unified with a pair of the permanent magnets by the adhesives 42, are mechanically stable, achieving robust isolators which are not deformed or damaged by vibrations or bumps.

The core isolators 30*a* and 30*b* have no yokes for suppressing leakage of magnetic flux to the outside thereof. Accordingly, a high frequency signal flowing in the core isolators 30*a* and 30*b* causes magnetic flux around the core isolators 30*a* and 30*b*. Depending on the arrangement of the core isolators 30*a* and 30*b*, there arises a problem in that the core isolators 30*a* and 30*b* are magnetically coupled with each other, resulting in failure to achieve desired characteristics of the isolators 8*a* and 8*b*.

Accordingly, in the circuit module 1, the core isolators 30*a* and 30*b* are arranged so as not to be magnetically coupled with each other. Specifically, the permanent magnets 41 cause direct-current (DC) magnetic fields B1 and B2 to be applied to the ferrites 32 of the core isolators 30*a* and 30*b* in directions normal to the principal surfaces 32*a* and 32*b* of the ferrites 32. As illustrated in FIG. 4, the core isolators 30*a* and 30*b* are mounted on the substrate body 14 so that the principal surfaces 32*a* and 32*b* of the ferrites 32 are perpendicular or substantially perpendicular to the principal surfaces S1 and S2 of the substrate body 14. In other words, the core isolators 30*a* and 30*b* are mounted on the substrate body 14 so that the directions of the DC magnetic fields B1 and B2 are parallel or substantially parallel to the principal surface S1.

If the DC magnetic field B1 is parallel or substantially parallel to the DC magnetic field B2 and passes through the core isolator 30*b*, the core isolator 30*a* is magnetically coupled with the core isolator 30*b*. Similarly, if the DC magnetic field B2 is parallel or substantially parallel to the DC magnetic field B1 and passes through the core isolator 30*b*, the core isolator 30*a* is magnetically coupled with the core isolator 30*b*. Accordingly, as illustrated in FIG. 1, in the circuit module 1, the core isolator 30*a* is mounted on the principal surface S1 of the substrate body 14, and the core isolator 30*b* is mounted on the principal surface S2 of the substrate body 14. According to the present preferred embodiment, as illustrated in FIG. 1, the core isolator 30*b* is mounted in the recess G provided in the principal surface S2. Further, the core isolator 30*b* does not overlap the core isolator 30*a* when viewed in plan from a direction normal to the principal surface S1.

Furthermore, as illustrated in FIGS. 1 and 3, the direction of the DC magnetic field B1 applied to the ferrite 32 of the core isolator 30*a* is different from that of the DC magnetic field B2 applied to the ferrite 32 of the core isolator 30*b*. According to the present preferred embodiment, as illustrated in FIG. 3, the DC magnetic field B1 occurs in the direction perpendicular or substantially perpendicular to the plane of FIG. 3, whereas the DC magnetic field B2 occurs in the direction from left to right of the plane of FIG. 3. Thus, the DC magnetic field B1 is orthogonal or substantially orthogonal to the DC magnetic field B2 when viewed in plan from a direction normal to the principal surface S1.

Since the core isolators 30*a* and 30*b* are mounted on the principal surfaces S1 and S2, respectively, the ground conductor layer 16 is provided between the core isolators 30*a* and 30*b*, as illustrated in FIG. 3.

The circuit module 1 according to the present preferred embodiment in which the multiple core isolators 30*a* and 30*b* having no yokes are mounted significantly reduces and prevents magnetic coupling between the core isolators 30*a* and 30*b*. More specifically, in the circuit module 1, the core isolators 30*a* and 30*b* are mounted on the principal surfaces S1 and S2 of the substrate body 14, respectively. Thus, compared with a circuit module in which two core isolators are mounted on the same principal surface, the circuit module 1 enables the core isolators 30*a* and 30*b* to be disposed separately from each other. Furthermore, since the substrate body 14 is provided between the core isolators 30*a* and 30*b*, the substrate body 14 isolates the DC magnetic fields B1 and B2 from each other. As a result, magnetic coupling between the core isolators 30*a* and 30*b* is significantly reduced and prevented.

In particular, according to the present preferred embodiment, the direction of the DC magnetic field B1 applied to the ferrite 32 of the core isolator 30*a* is different from that of the DC magnetic field B2 applied to the ferrite 32 of the core isolator 30*b*. Thus, magnetic coupling between the core isolators 30*a* and 30*b* is effectively significantly reduced and prevented. The DC magnetic field B1 is orthogonal or substantially orthogonal to the DC magnetic field B2 when viewed in plan from a direction normal to the principal surface S1, achieving further effective reduction and prevention of magnetic coupling between the core isolators 30*a* and 30*b*.

In the circuit module 1, the ground conductor layer 16 is provided between the core isolators 30*a* and 30*b*. Since a ground potential is applied to the ground conductor layer 16, the ground conductor layer 16 isolates the DC magnetic fields B1 and B2 from each other. As a result, magnetic coupling between the core isolators 30*a* and 30*b* is significantly reduced and prevented.

In the circuit module 1, the core isolators 30*a* and 30*b* do not overlap each other when viewed in plan in a direction normal to the principal surface S1. Thus, the core isolators 30*a* and 30*b* are disposed separately from each other, achieving significantly reduction and prevention of magnetic coupling between the core isolators 30*a* and 30*b*.

In addition, in the circuit module 1, the metal case 50 to which a ground potential is applied covers the principal surface S1 of the substrate body 14. Accordingly, intrusion of noise into the electronic components such as the core isolator 30*a* mounted on the substrate body 14 is reliably prevented. Further, emission of noise, which is emitted from the electronic components such as the core isolator 30*a* mounted on the substrate body 14, to the outside of the circuit module 1 is significantly reduced and prevented.

Furthermore, in the circuit module 1, the recess G is provided in the principal surface S2 of the substrate body 14, and the core isolator 30*b* is mounted in the recess G. As a result, the profile of the circuit module 1 is reduced.

In the circuit module 1 according to the present preferred embodiment, a multilayer body obtained by stacking multiple resin layers on top of one another may be used instead of the circuit board 2 such as a printed wiring board. In this case, the core isolators 30*a* and 30*b* may be mounted on different insulating layers.

Figure 9:
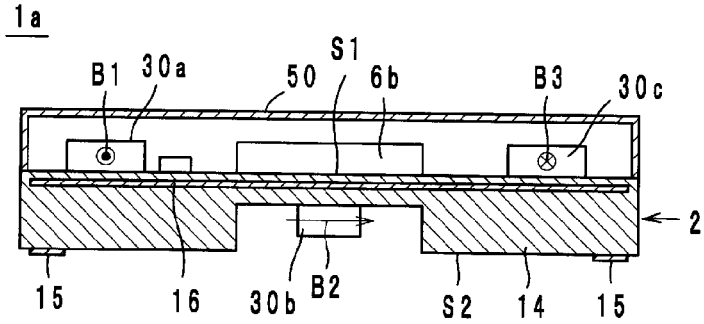
FIG. 9 is a sectional structure view of a circuit module according to a first exemplary modification of a preferred embodiment of the present invention.

A circuit module 1*a* according to a first exemplary modification of a preferred embodiment of the present invention will be described below with reference to the drawing. FIG. 9 is a sectional structure view of the circuit module 1*a* according to the first exemplary modification of a preferred embodiment of the present invention.

As illustrated in FIG. 9, in the circuit module 1*a*, a core isolator 30*c* is mounted on the principal surface S1 of the substrate body 14. Note that the power amplifier 6*b* is mounted between the core isolators 30*a* and 30*c* on the principal surface S1. Thus, the power amplifier 6*b* isolates the DC magnetic field B1 and a DC magnetic field B3, which are applied to the ferrites of the core isolators 30*a* and 30*c*, from each other. As a result, even when the multiple core isolators 30*a* and 30*b* are mounted on the same principal surface S1, magnetic coupling between the core isolators 30*a* and 30*b* is significantly reduced and prevented.

Figure 10:
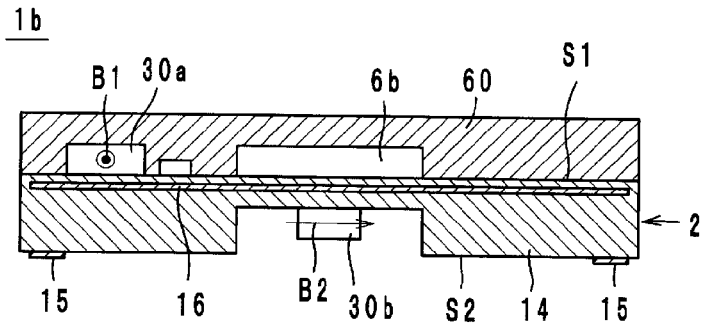
FIG. 10 is a sectional structure view of a circuit module according to a second exemplary modification of a preferred embodiment of the present invention.

A circuit module 1*b* according to a second exemplary modification of a preferred embodiment of the present invention will be described below with reference to the drawing. FIG. 10 is a sectional structure view of the circuit module 1*b* according to the second exemplary modification of a preferred embodiment of the present invention.

The circuit module 1*b* includes an insulating resin 60 which is provided on the principal surface S1 and which covers the core isolator 30*a*, instead of the metal case 50. In the circuit module 1*b*, the insulating resin 60 covers the entire principal surface S1. Thus, the insulating resin 60 protects the electronic components such as the core isolator 30*a* mounted on the principal surface S1.

Figure 11:
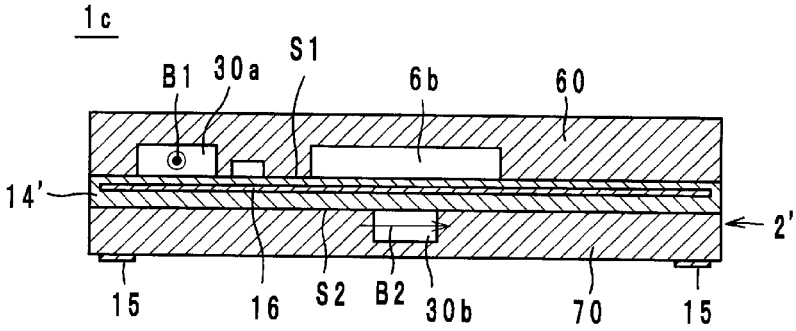
FIG. 11 is a sectional structure view of a circuit module according to a third exemplary modification of a preferred embodiment of the present invention.

A circuit module 1*c* according to a third exemplary modification of a preferred embodiment of the present invention will be described below with reference to the drawing. FIG. 11 is a sectional structure view of the circuit module 1*c* according to the third exemplary modification of a preferred embodiment of the present invention.

The circuit module 1*c* includes an insulating resin 70 which covers the core isolator 30*b* and which is provided on the principal surface S2 of a plate-shaped substrate body 14' in which the recess G is not provided. The outer electrodes 15 are provided on the insulating resin 70. The insulating resin 70 is formed by mounting the core isolator 30*b* on the principal surface S2 of the substrate body 14' and then applying a resin material to the principal surface S2. Thus, without providing the recess G as in the substrate body 14, the core isolator 30*b* can be included in the inside of the substrate body 14 and the insulating resin 70.

In the circuit modules 1, 1*a*, and 1*b*, the ground conductor layer 16 is preferably included on the upper side of the bottom surface of the recess G in the substrate body 14. However, the ground conductor layer 16 may be provided at the same height as the bottom surface of the recess G. In this case, a portion of the ground conductor layer 16 may be exposed on the bottom surface of the recess G. Further, in the circuit module 1*c*, the ground conductor layer 16 may be provided on the principal surface S2.

The recess G of the circuit modules 1, 1*a*, and 1*b* may be filled with insulating resin. Thus, the insulating resin protects the core isolator 30*b*.

As described above, various preferred embodiments of the present invention are useful for a circuit module, and, particularly, provide an advantage in that a circuit module in which multiple core isolators having no yokes are mounted enables magnetic coupling between the core isolators to be significantly reduced and prevented.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A circuit module comprising:

a multilayer body including a plurality of insulating layers stacked on top of one another; and first and second core isolators each including:

a ferrite;

a permanent magnet that applies a direct-current magnetic field to the ferrite;

a first center electrode provided for the ferrite, the first center electrode having one end thereof connected to an input port and the other end thereof connected to an output port; and a second center electrode provided for the ferrite and arranged to intersect the first center electrode while being insulated therefrom, the second center electrode having one end thereof connected to the output port and the other end thereof connected to a ground port;

the first and second core isolators having no yokes preventing leakage of the direct-current magnetic field to outside; wherein each of the first and second core isolators is mounted on a different one of the insulating layers such that a direction of the direct-current magnetic field is parallel or substantially parallel to a principal surface of the insulating layers.

2. The circuit module according to claim 1, wherein the multilayer body includes a circuit board including a first principal surface and a second principal surface, and the first core isolator and the second core isolator are mounted on the first principal surface and the second principal surface, respectively.

3. The circuit module according to claim 2, wherein the direction of the direct-current magnetic field applied to the ferrite of the first core isolator is different from the direction of the direct-current magnetic field applied to the ferrite of the second core isolator.

4. The circuit module according to claim 3, wherein when viewed in plan in a direction normal to the first principal surface, the direction of the direct-current magnetic field applied to the ferrite of the first core isolator is orthogonal or substantially orthogonal to the direction of the direct-current magnetic field applied to the ferrite of the second core isolator.

5. The circuit module according to claim 2, wherein the circuit board includes a ground conductor layer provided between the first core isolator and the second core isolator.

6. The circuit module according to claim 2, further comprising:

a third core isolator mounted on the first principal surface; and an electronic component mounted between the first core isolator and the third core isolator on the first principal surface.

7. The circuit module according to claim 2, wherein the first core isolator and the second core isolator do not overlap each other when viewed in plan in a direction normal to the first principal surface.

8. The circuit module according to claim 2, wherein a recess is provided in the second principal surface of the circuit board, and the second core isolator is mounted in the recess.

9. The circuit module according to claim 2, further comprising:

a first insulating resin provided on the first principal surface, the first insulating resin covering the first core isolator; and a second insulating resin provided on the second principal surface, the second insulating resin covering the second core isolator.

* * * * *